United States Patent [19]

Gaddy

[11] 4,161,137

[45] Jul. 17, 1979

[54] ROCKER WHEEL JACK FOR AN OIL-WELL PUMP

[76] Inventor: Arthur K. Gaddy, 925 Gabaldon NW., Albuquerque, N. Mex. 87104

[21] Appl. No.: 777,466

[22] Filed: Mar. 14, 1977

[51] Int. Cl.[2] ..... F01B 9/00

[52] U.S. Cl. ..... 92/13; 74/66; 74/70; 92/137; 166/68

[58] Field of Search ..... 166/68, 68.5, 104; 74/41, 66, 70; 92/137, 13, 13.1, 13.7; 417/46, 539

[56] References Cited

U.S. PATENT DOCUMENTS

| | | | |
|---|---|---|---|
| 341,637 | 5/1886 | Carnahan | 74/41 |
| 828,680 | 8/1906 | Quick | 166/68.5 X |
| 856,271 | 6/1907 | Linthicum | 417/539 X |
| 1,537,844 | 5/1925 | McDonald | 92/137 |
| 1,890,428 | 12/1932 | Ferris et al. | 92/137 X |
| 2,042,294 | 5/1936 | Bloss | 74/41 |
| 2,180,400 | 11/1939 | Coberly | 417/46 X |
| 2,683,424 | 7/1954 | Kane | 92/137 X |
| 2,958,237 | 11/1960 | Johnson | 74/41 X |
| 3,807,902 | 4/1974 | Grable et al. | 417/46 |

*Primary Examiner*—Carlton R. Croyle
*Assistant Examiner*—Edward Look
*Attorney, Agent, or Firm*—Otto John Munz

[57] ABSTRACT

A rocker wheel jack is arranged on a compact frame so that the driving mechanism is placed below the rocker wheel. The mechanism is adjustable so as to vary the spacing between it and a drive wheel. The rocker wheel is adjustably spaced from the drive wheel. A pitman connects the drive wheel and the rocker wheel. The pitman connections to the wheels are further adjustable radially to the wheels. Thus a jack is provided with a possibility of multiplicity of adjustments and a minimum of vertical space and of weight for the jack. The complete unit is readily movable. The driving mechanism is readily accessible for repair or replacement. An oil level sensor is provided in the well with connections transmitting its output to the R.P.M. of the jack.

2 Claims, 8 Drawing Figures

ROCKER WHEEL JACK FOR AN OIL-WELL PUMP

BACKGROUND OF THE INVENTION

The invention relates to lift pumps in combination with oil wells and the like and, more particularly, to improvements which permit modification of the rocker arm to minimize space and weight requirements and to provide various ways for adjustability of the apparatus relative to the well. Class 166–68.

DESCRIPTION OF THE PRIOR ART

Known in the prior art is a pump having a rocker arm pivotally mounted on an elevated base. To one side of this base is the usual rotating drive mechanism connected by a pitman to the rocker arm. The drive mechanism is connected by a belt to a motor further to one side so that the various parts of the jack are spread out horizontally. Customarily, a counterbalance element is carried by the rocker arm on the other side of the pivot from the sucker rod connection. Thus, the pump parts are spread out laterally and usually with attendant heavy weight and extra expense for materials for the unit.

Usually, the rocker arm is rather long so as to increase the advantage of the force from the driving acting on the rocker arm in lever style. The end of the rocker arm connected to the sucker rod has a "horsehead"-shape, further adding to the weight. Thus, the counterbalance is also relied on to balance off the weight of the "horsehead" as well as the attendant weight of the sucker rod. Since much weight must be moved by the drive mechanism the size and weight thereof are correspondingly increased. This is a considerable disadvantage since the pump must be moved to a shop for replacement. The height of the conventional pump makes it difficult and expensive to provide a cover for it, which is required in populated locations as a precaution against accidents.

The assembly of the conventional pump requires about 4 hours of work by two men with heavy equipment. Even in the smallest size it comes in 3 parts exclusive of weights.

SUMMARY OF THE INVENTION

The present invention teaches a manner of making a stationary pump jack of minimum size and weight, yet adequate for the purpose intended.

The apparatus comprises a frame mounting a rocker wheel above the driving mechanism so that there is provided a very desirable economy of space both laterally and in height.

By providing a rocker wheel a considerable reduction in size and weight is obtained over the usual rocker arm. The rocker wheel is pivotally mounted at the top of a support frame. Just below the rocker wheel a rotatable drive wheel is mounted on the surface and below the drive wheel a drive motor for the drive wheel is also mounted on the frame.

A belt driven by the motor rotates the drive wheel. One end of an operating arm is attached to the drive wheel and the other end to the rocker wheel so that rotation of the drive wheel imparts rocker movement to the rocker wheel. The rocker wheel supports at least two cables over the top part of the rocker wheel. The cable is attached at one end to a series of weights and at the other end it is attached to a bridle which supports the sucker rod. The length and weight of the sucker rod varies with the depth of the well and the amount of weight is varied to counterbalance the weight of the sucker rod. Because of the weights on both ends of the cable the cable is frictionally bound to the rocker wheel against slippage.

The pump of the present invention is of light weight and small, can be assembled, depending on its size, by a single person, without heavy equipment, because it comes preassembled in smaller sizes as a single unit and in larger sizes in only two parts, can be easily covered and can be replaced or repaired promptly in the field.

DESCRIPTION OF THE PREFERRED EMBODIMENTS

Figure 2:
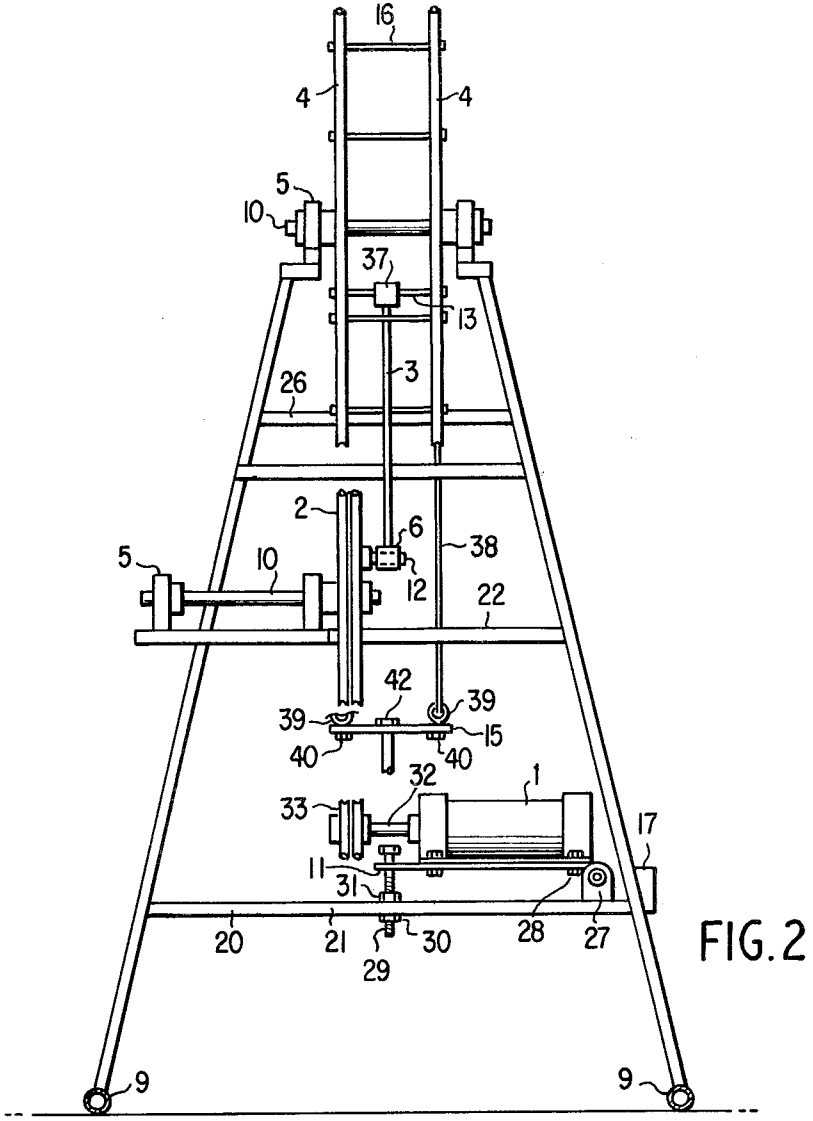
FIG. 2 is a view in the direction of the arrows II—II of FIG. 1, omitting the weights and the drive belt.
Figure 1:
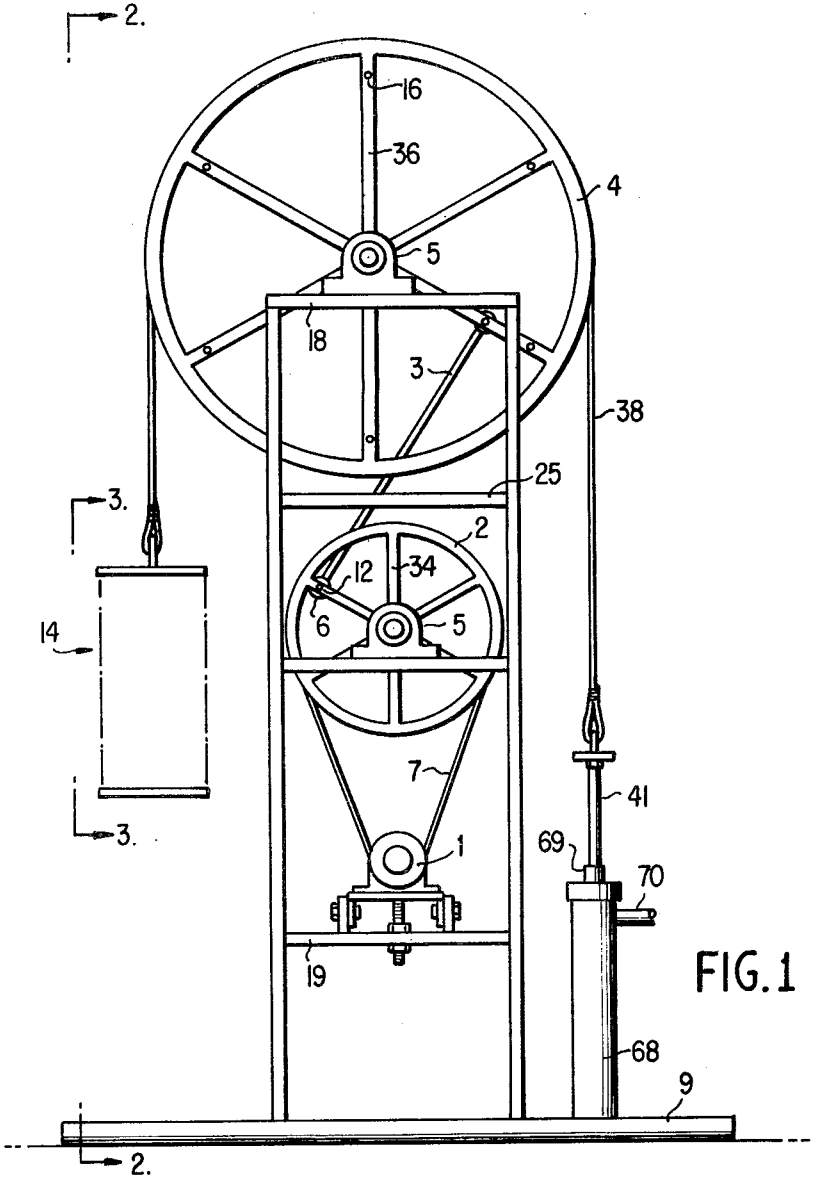
FIG. 1 is a side elevation of the rocker wheel jack showing mounting of the wheel on top of a support, the support also carrying the drive wheel and the motor therebelow.
Figure 3:
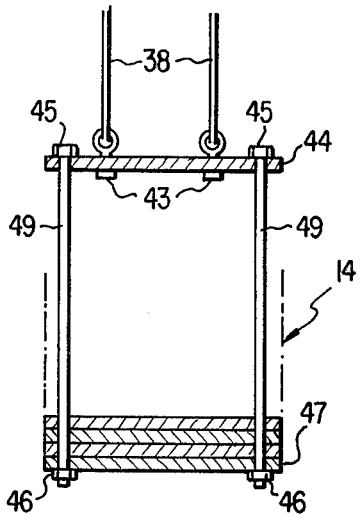
FIG. 3 shows a manner of providing separate pieces for a counterweight.

With reference to FIGS. 1 to 3 the support frame A for the device comprises a pair of base members 9 each of which may be long enough to extend outwardly beyond the diameter of the rocker wheel 4. A pair of uprights 8 extend upwardly from each of the base members 9 to a bearing support 18. Each support 18 carries thereon a bearing 5 which, in turn, supports a shaft which rockably carries the rocker wheel 4.

Slightly above the base members 9 there is a support for the motor 1. This support has a cross piece 19 parallel to base member 9 joined to uprights 8. The ends of the cross pieces 19 then are connected to a pair of pieces 20 where these connect with the uprights 8. A further cross piece 21 then connects to the pieces 20 to provide a base for a jack to be described below.

Similarly, a support for the drive wheel 2 is provided on the frame A. A pair of pieces 22, generally parallel to pieces 20, connect the uprights 8. Across these pieces 20 near one end is a cross piece 23 and inwardly of piece 23 is a second piece 24. Alternatively, a single wide piece, not shown, could be provided in lieu of the two shown. The cross pieces 23 and 24 each support a bearing 5, which supports a shaft 10 for rotation.

Further stiffening of the frame may be required. Two such stiffeners 25 may be added between the uprights 8 parallel to the base members 8 and below the bearing supports 18 and above the shaft 10. Two more stiffeners 26 parallel to the shaft 10 connect the uprights 8, positioned so as to clear the rocker wheel 4. With due consideration as to the strength of materials needed, the sizes of the various elements are selected to provide an adequate frame.

The motor 1 is bolted on a plate 11 at 28. The plate is hingedly mounted on a cross piece 19 at 27. A threaded rod or jack 29, attached to the plate 11, extends through a hole, not marked, in cross piece 21. Adjusting nuts 30 and 31 on the rod 29 below and above the piece 21 control the movement of the rod 29 and thereby the position of the plate 11 to provide a suitable tension on the belt 7, next described. A pulley 33 is mounted on the shaft 32 of the motor.

The drive wheel 2 is also a pulley, mounted on shaft 10. A belt 7 connects wheel 2 to pulley 33. See FIG. 1. A stud 12 extends parallel to the shaft 10 from one of the spokes 34 of the drive wheel 2.

The rocker wheel 4 may consist of two axially spaced apart wheels, held in spaced relation by spacer bolts 16 connected to corresponding spokes 36 of each wheel. The bolts 16 are located near the rims of the wheels 4. Inwardly of one bolt 16 towards the shaft 10 another stud 13 connects a corresponding spoke or spokes 36. The stud carries a sleeve 37. An operating arm or pitman rod or rocker arm 3 connects the sleeve 37 with the sleeve 6 on the stud 12. The studs 12 and 13 are so located on the spokes 34 and 36 that, on rotating the wheel 2, the rod 3 can rock the wheel 4 without the rod 3 binding on the bolts 16.

The rocker wheels may be made of a pair of wheels for ease of supporting the end of the rocker arm between them and to provide a groove on the rim of each wheel to carry a cable 38. One end of each of the cables supports a "bridle" 15 by connection to an eyebolt 39. The eyebolt extends through the bridle 15 and is held therein by a nut 40. The sucker rod is connected to the bridle by extending therethrough. A nut 42 secures the sucker rod to the bridle.

The other ends of cables 38 are connected to a bar 44 by nut 45. Suspended from this bar is another bar or plate 47 which serves as a carrier for counterweights 14. Plate 47 is held on the rods 49 by nuts 46. Rods 49 are supported by the bar 44 by nuts 45.

Details of the support for the counterweights 14, the bridle 15 and the manner of adjusting the motor support plate may be varied to suit requirements, the details shown herein being exemplary. For example, the counterweights could be circular with radial slots fitting on a support rod 49. While two wheels 4 are shown, only one is necessary, the second is added for ease of supporting the arm 3 and the cable 38.

Figure 4:
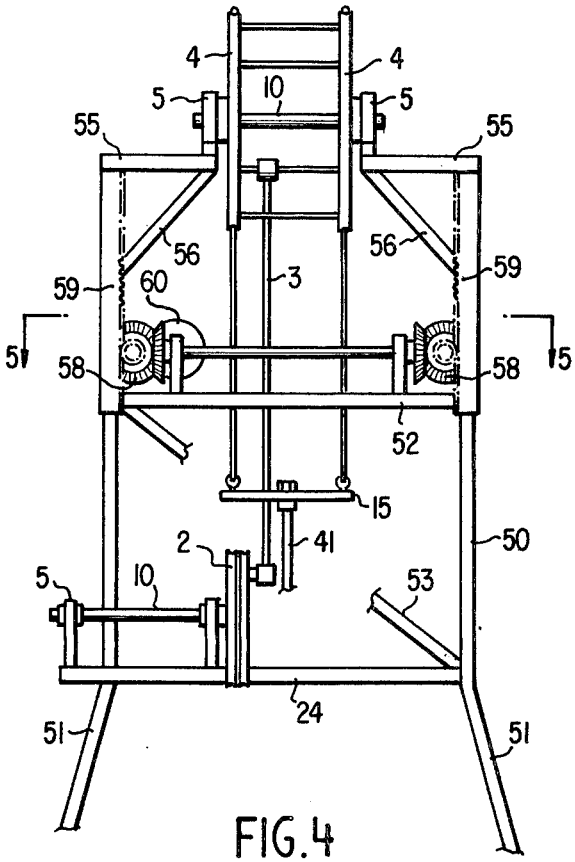
FIG. 4 is an elevation similar to FIG. 2 of an arrangement to vary the spacing between driver shafts.
Figure 6:
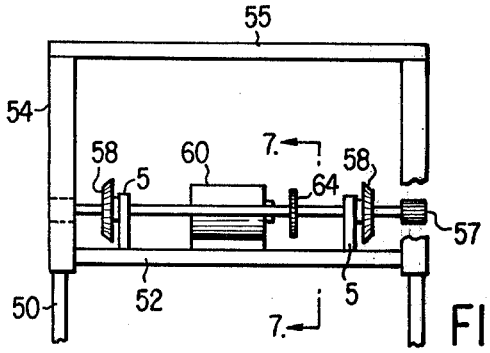
FIG. 6 is a view taken along the arrows VI—VI of FIG. 5 showing a detail of the mitre gear.

In FIG. 4 there is shown one way of varying the distance between the shaft 10 so as to vary the pumping effect of the operating arm 3. The frame below the level of the drive wheel 10 is retained intact. A riser 50 extends above piece 22 over each of the uprights 51 (the lower portions of uprights 8 in FIG. 2). An open center rectangular plate 52 is secured at its corners to the risers 50. A brace 53 extends between the risers 50 on each side of the rectangle down to the opposite intersections of the risers with the pieces 22. Tubes 54 of shapes complementary to the risers 50, are telescopic thereover. Bearing supports 55 similar to supports 18, are each attached to a pair of the tube 54. Supports 55 extend toward each other and each supports a bearing. The bearings then support the rocker wheel 4 as previously described. A bracket 56 from each end of support is secured to tube 54 to prevent tilting of the support.

Figure 5:
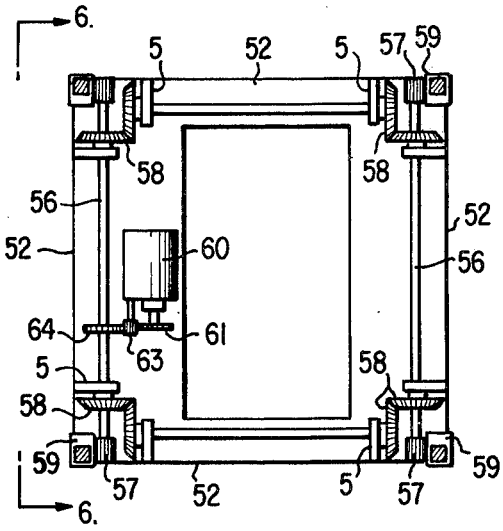
FIG. 5 is view taken along arrows V—V of FIG. 4 showing one system of mitre gears.

In FIG. 5 the plate 52 is shown joined to the riser 50. Mounted on the plate 52 are shafts 56, 57. At the corners a gear 58 is mounted on each end of the shafts. The plate carries a pair of bearings 5 for each shaft 56, 57. Each end of the shafts 56 carries a pinion gear 58 in mesh with a corresponding rack gear 59 on each of the tubes 54. A variable speed reversible motor 60 is supported on the plate 52. Motor 60 drives a gear 61 mounted on its shaft 62 drives an idler gear 63. The idler gear then drives gear 64 fixed on a shaft 56. In this arrangement the motor drives the pinions 58 all at once to raise or lower the tubes 54 on the risers 50. Thereby, the spacing between the shafts 10.

Figure 7:
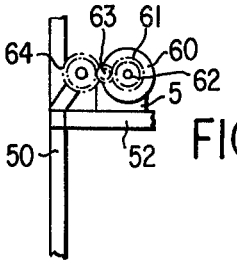
FIG. 7 is a view taken along the arrow VII—VII of FIG. 6 showing a further detail of the mitre gear.
Figure 8:
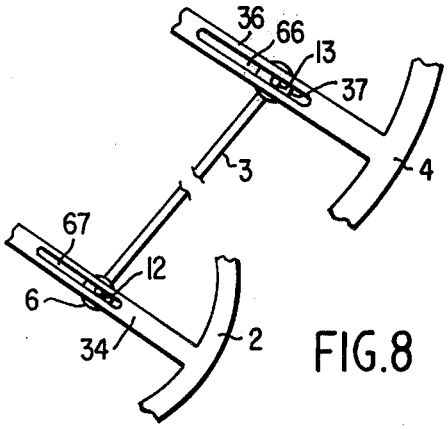
FIG. 8 is a view showing the adjustable connections of the pitman ends to the drive and rocker wheels.

In FIG. 7 the idler gear 63 is carried on a stub shaft 65 carried on the adjacent bearing 5. The connections 13 to rocker wheel 4 and 12 to drive wheel 2 may be adjustable as shown in FIG. 8. A pair of spokes 36 may have elongated slots 66 along which the stud 13 may be adjustably secured. Similarly, a spoke 34 may have an elongated slot 67 along which the stud 12 may be adjustably fixed. The sucker rod 41 extends into the pump tubing 68 through a stuffing box 69. Below this box the tubing has an outlet 70 for connection to a tank. An oil level sensor 71 is shown for placing in the well, not shown, for connection with a switch box 17 to control the motor 1.

Similarly, an oil level sensor may be connected to motor 60 for varying the spacing between the shafts 10 to vary the length of stroke of the sucker rod.

What is claimed is:

1. A wheel jack comprising:

a support frame, a drive motor, means supporting the drive motor on the frame, a rotating rocker drive, means supporting the rotating rocker drive on the frame, a rocker wheel, means supporting the rocker wheel for back-and-forth rocking movement on the frame, means connecting the motor to the rocker drive for moving the latter, means connecting the rocker drive to the wheel for rocking the latter back and forth, and cable means supported on the wheel so that back-and-forth movement of the wheel moves one end of the cable means to operate a sucker rod, for example, the rocker drive being supported on a first shaft and the rocker wheel on a second shaft spaced from the first shaft, further comprising means to variably spaced the first and the second shafts relative to each other.

2. A wheel jack as claimed in claim 1, said means to space including a reversible motor drive.

* * * * *